US010655652B1

(12) United States Patent
Manchester et al.

(10) Patent No.: US 10,655,652 B1
(45) Date of Patent: May 19, 2020

(54) RECIPROCAL MOTION FLUID CYLINDER ASSEMBLY

(71) Applicant: REVOLUTIONARY POWER LLC, The Villages, FL (US)

(72) Inventors: James R. Manchester, The Villages, FL (US); Stanley L. Baker, The Villages, FL (US)

(73) Assignee: REVOLUTIONARY POWER LLC, The Villages, FL (US)

( * ) Notice: Subject to any disclaimer, the term of this patent is extended or adjusted under 35 U.S.C. 154(b) by 0 days.

(21) Appl. No.: 16/379,872

(22) Filed: Apr. 10, 2019

(51) Int. Cl.
*F15B 15/10* (2006.01)

(52) U.S. Cl.
CPC ..... *F15B 15/10* (2013.01)

(58) Field of Classification Search
CPC ..... F15B 15/10; F15B 15/103; F15B 1/103; F15B 2201/3153; F04B 43/00; F04B 45/00; F04B 45/022; F04B 45/024; F04B 45/033
USPC ..... 92/34, 37
See application file for complete search history.

(56) References Cited

U.S. PATENT DOCUMENTS 2,747,614 A * 5/1956 Gray ..... G01L 13/02 92/38
2,749,942 A * 6/1956 Yowell ..... F15B 15/10 92/34
2,897,650 A * 8/1959 Carlson, Jr. ..... F15B 15/10 60/326
4,769,992 A * 9/1988 Harada ..... F02G 1/0435 277/401
4,995,304 A * 2/1991 Daimler ..... B23Q 1/34 417/375
9,038,433 B2 * 5/2015 Skjetne ..... F16L 55/04 73/1.71
2010/0308589 A1 * 12/2010 Rohrer ..... F03B 13/188 290/53
2012/0085984 A1 4/2012 Daya

* cited by examiner

*Primary Examiner* — Dustin T Nguyen
(74) *Attorney, Agent, or Firm* — Allen Dyer Doppelt & Gilchrist, PA

(57) ABSTRACT

A fluid cylinder includes an outer cylinder surrounding expandable intermediate and inner cylinders. A first sealed volume is defined between the outer cylinder and the intermediate cylinder, a second sealed volume is defined between the intermediate cylinder and the inner cylinder and a third volume defined within the inner cylinder. The first sealed volume is held at a lower pressure than the second and third volumes. At upper heights of the intermediate and inner cylinders, the pressures of the second and third volumes are approximately equal. Exerting a downward force on a linkage connected to a top end of the inner cylinder results in changes in pressure-volume relationships, causing the intermediate cylinder to fall and, upon release of the downward force, causing the intermediate and inner cylinders to rise again to their upper heights. The reciprocal motion generated can be harnessed for various purposes.

20 Claims, 7 Drawing Sheets

RECIPROCAL MOTION FLUID CYLINDER ASSEMBLY

FIELD OF THE INVENTION

The present invention relates to generating reciprocal motion, and more particularly, to an apparatus and methods for generating reciprocal motion using a cylinder with fluids with varying pressure differentials.

BACKGROUND OF THE INVENTION

The basis for many machines is the repetitive generation of reciprocal motion, which motion can then be used to do work. For instance, the reciprocal stroke of an internal combustion motor piston is converted to rotational motion and used to power vehicles, generate electricity and for myriad other uses.

In many instances, reciprocal motion is generated via the introduction of fluid into a cylinder (e.g., as in early steam locomotives) or via the rapid expansion of fluid within the cylinder via combustion or other thermal input (e.g., as in an internal combustion motor). While such mechanisms have proven to be useful and reliable, it would be valuable to develop other mechanisms for generating reciprocal motion.

SUMMARY OF THE INVENTION

In view of the foregoing, it is an object of the present invention to provide a reciprocal motion fluid cylinder assembly. More particularly, it is an object of the present invention to provide a fluid cylinder assembly that generates varying pressure differentials therein to generate reciprocal motion.

A fluid cylinder assembly includes, an outer cylinder, an intermediate cylinder, an inner cylinder and a linkage connected to the inner cylinder. The outer cylinder extends between outer cylinder top and bottom ends with the outer cylinder top end being sealed.

The intermediate cylinder is arranged within the outer cylinder and extends between intermediate cylinder top and bottom ends. The intermediate cylinder top end is sealed, and the bottom end is sealed to the outer cylinder bottom end such that a first sealed volume is defined between the outer cylinder and the intermediate cylinder. The intermediate cylinder top end is collapsible towards the intermediate cylinder bottom end such that an intermediate cylinder height is variable with the first sealed volume varying in inverse proportion to the intermediate cylinder height.

The inner cylinder is arranged within the intermediate cylinder and extends between inner cylinder top and bottom ends. The inner cylinder top end is sealed and the bottom end is sealed to the outer cylinder bottom end such that a second sealed volume is defined between the intermediate cylinder and the inner cylinder and a third volume is defined within the inner cylinder. The inner cylinder top end is collapsible towards the inner cylinder bottom end such that an inner cylinder height is variable with the second sealed volume varying in direct proportion to a difference between the intermediate and inner cylinder heights.

The linkage is connected to the inner cylinder and extends below the outer cylinder bottom end such that downward force on the linkage reduces the inner cylinder height.

In a resting condition of the fluid cylinder assembly, a first sealed volume pressure is lower than a second sealed volume pressure by a pressure differential sufficient to hold the intermediate cylinder upper end at an upper intermediate cylinder height and a second sealed volume pressure is approximately equal to a third volume pressure such that a second pressure difference is approximately zero and the inner cylinder upper end is held at an upper inner cylinder height.

Reducing the inner cylinder height from the upper inner cylinder height by exerting a downward force on the linkage reduces the pressure differential until the intermediate cylinder upper end falls from the upper intermediate cylinder height and releasing the downward force on the linkages results in the intermediate and inner upper cylinder ends automatically returning to the intermediate and inner upper cylinder upper heights, respectively.

Another aspect is directed to a method to generate electricity using a vacuum cylinder comprising a tube, a first expandable hose having a first diameter positioned within the tube, and a second expandable hose having a second diameter larger than the first diameter and concentrically positioned around the first expandable hose within the tube, and a sliding cylindrical body coupled to and above the second cap within the tube, is disclosed. The method includes generating a vacuum pressure between a top portion of the tube and the sliding cylindrical body, opening a first valve in communication with an interior of the first expandable hose and proximate to a bottom end of the tube, and opening a second valve in communication with a space between the first and second expandable hoses and proximate to the bottom end of the tube causing the sliding cylindrical body to rise from the bottom end towards the top end of the tube as ambient air fills the first and second expandable hoses. In addition, the method includes holding the sliding cylindrical body stationary when it reaches the top portion of the tube, and closing the second valve. The method also includes pulling the first expandable hose downward to separate the first and second expandable hoses a pre-determined distance to cause a low pressure void under the sliding cylindrical body, resulting in the sliding cylindrical body falling towards the bottom end of the tube. In some aspects, this motion of the sliding cylindrical body within the tube can be converted to electricity.

These and other objects, aspects and advantages of the present invention will be better appreciated in view of the drawings and following detailed description of preferred embodiments.

DETAILED DESCRIPTION OF PREFERRED EMBODIMENTS

In the summary of the invention, provided above, and in the descriptions of certain preferred embodiments of the invention, reference is made to particular features of the invention, for example, method steps. It is to be understood that the disclosure of the invention in this specification includes all possible combinations of such particular features, regardless of whether a combination is explicitly described. For instance, where a particular feature is disclosed in the context of a particular aspect or embodiment of the invention, that feature can also be used, to the extent possible, in combination with and/or in the context of other particular aspects and embodiments of the invention, and in the invention generally.

The apparatus and methods described herein are based on an application of Boyle's Law which states that the absolute pressure exerted by a given mass of an ideal gas is inversely proportional to the volume it occupies if the temperature and amount of gas remain unchanged within a closed system;

expressed mathematically: $PV=k$, where P is the pressure of the gas, V is the volume of the gas and k is a constant.

The apparatus and methods use air pressure and gravity, aided by a downward force. The mass could be a magnet used in a linear generator, a mass used in a pile driver, or almost any other item which requires reciprocal motion. With proper interfaces this linear motion could be converted to rotary motion. The air pressure could be either ambient or some source of higher than normal pressure. Additionally, the principles of the invention would also be applicable to liquids, as all fluids (i.e., gases and liquids) follow Boyle's Law within closed systems.

Figure 1:
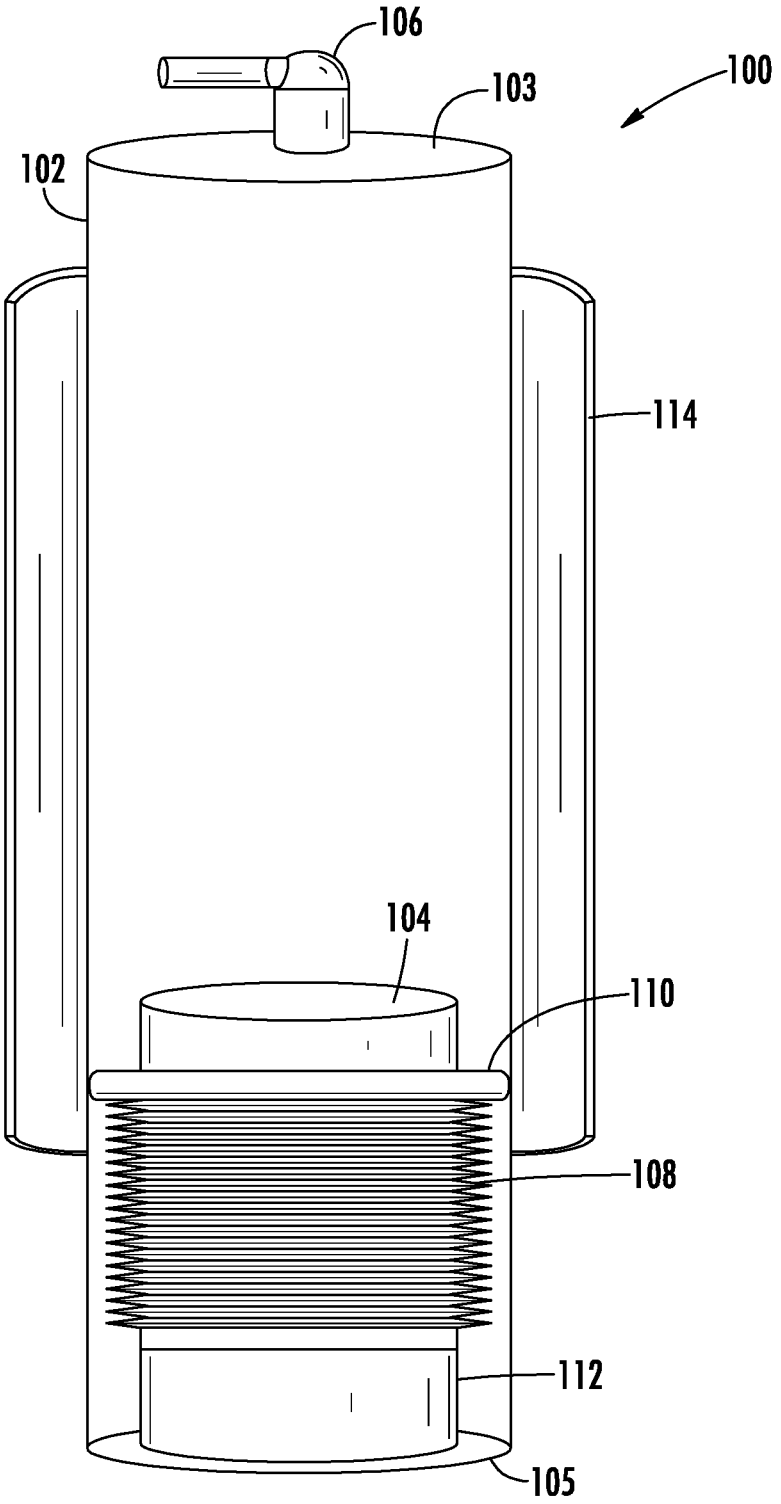
FIG. 1 is a schematic diagram of an apparatus in which various aspects of the disclosure may be implemented.
Figure 2:
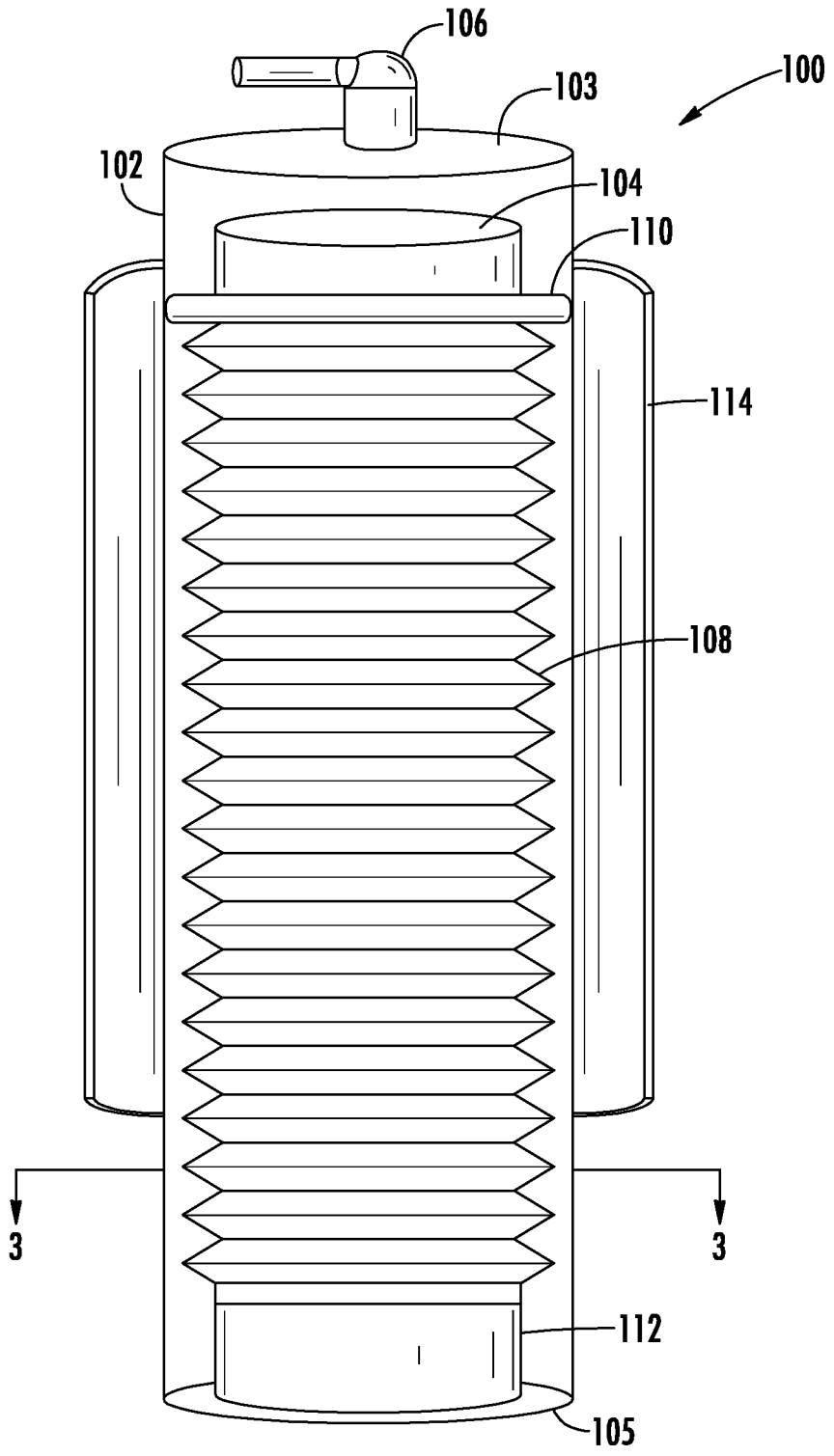
FIG. 2 is another schematic diagram of the apparatus.

Referring now to FIGS. 1 and 2, a schematic diagram of a fluid cylinder assembly 100 that generates electricity is illustrated, although fluid cylinders configured for other purposes or simply demonstrational and educational purposes are possible within the scope of the present invention. The assembly 100 includes a tube 102 having a top end 103 and a bottom end 105, which forms an outer cylinder of the assembly. A first expandable hose 116 having a first diameter is positioned within the tube 102, but is not visible in FIGS. 1 and 2 because a second expandable hose 108 having a second diameter larger than the first diameter is concentrically positioned around the first expandable hose 116 within the tube 102. The first expandable hose 116 (visible in FIGS. 3-6) forms an inner cylinder of the assembly and the second expandable hose 108 forms an intermediate cylinder of the assembly.

The second expandable hose 108 is shown in a fully collapsed state in FIG. 1, and is shown in an expanded state in FIG. 2.

A sleeve 112 is proximate the bottom end 105 of the tube 102 and the second expandable hose 108 is coupled to the sleeve 112. A second cap 110 is connected to the top of the second expandable hose 108.

In addition, a sliding cylindrical body 104 is arranged on the second cap 110. The sliding cylindrical body 104 has a selected mass that is used to drive the apparatus 100. In a particular aspect, a generator 114 in the form of a coil 114 surrounds at least a portion of the tube 102 and is used to generate electricity from the linear motion of the sliding cylindrical body 104 within the tube 102. A pump 106 may be coupled to the top portion of the tube 102 and be configured to generate and hold a pre-determined vacuum pressure in a first sealed volume between the tube 102 and the second expandable hose 108 as explained below.

Figure 3:
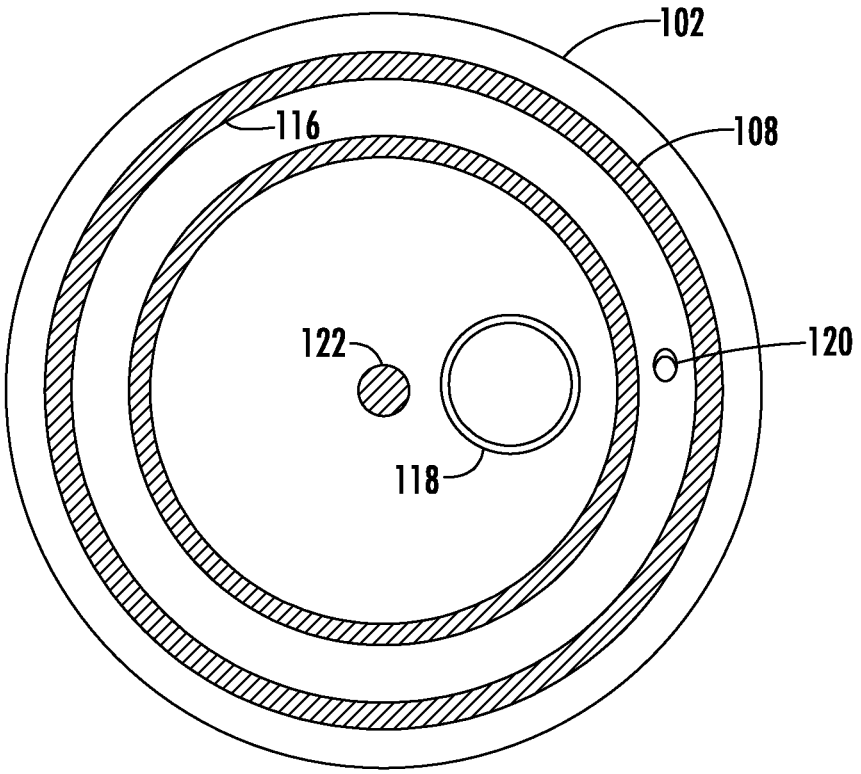
FIG. 3 is a cross sectional view of the apparatus taken in the direction of line 3-3 of FIG. 2.

FIG. 3 is a cross sectional view of the apparatus 100 taken in the direction of line 3-3 of FIG. 2. In particular, the arrangement of the first expandable hose 116 relative to the second expandable hose 108 is illustrated. The second sealed volume inside the smaller first expandable hose 116 is isolated from the larger second expandable hose 108.

A first hole 118 is in communication with an interior of the first expandable hose 116 and proximate to the bottom end 105 of the tube 102. A first valve 136 connects the inside of the first expandable hose 116 to the air outside the tube 102 allowing air to flow freely between the third volume inside the first expandable hose 116 and the air outside the tube 102—typically atmospheric pressure, although some other controlled, constant fluid pressure could be used. The first valve 136 could be omitted altogether, with the third volume within the hose 116 simply being freely vented. In such case, the first "hole" could be essentially coextensive with the cross-sectional diameter of the hose 116.

A second hole 120 is in communication with a second sealed volume between the first expandable hose 116 and second expandable hose 108 and is also proximate to the bottom end 105 of the tube 102. A second valve 126 allows air to be added or removed from this second sealed volume. Alternately, once the desired amount of air is introduced in the second sealed volume, it can simply be sealed off without a valve. Preferably, with hoses 116 and 108 at their upper heights (as shown in FIG. 5, which represents a resting condition), the second sealed volume is at approximately the same pressure as the volume inside the tube 108 (e.g., atmospheric pressure).

Figure 4:
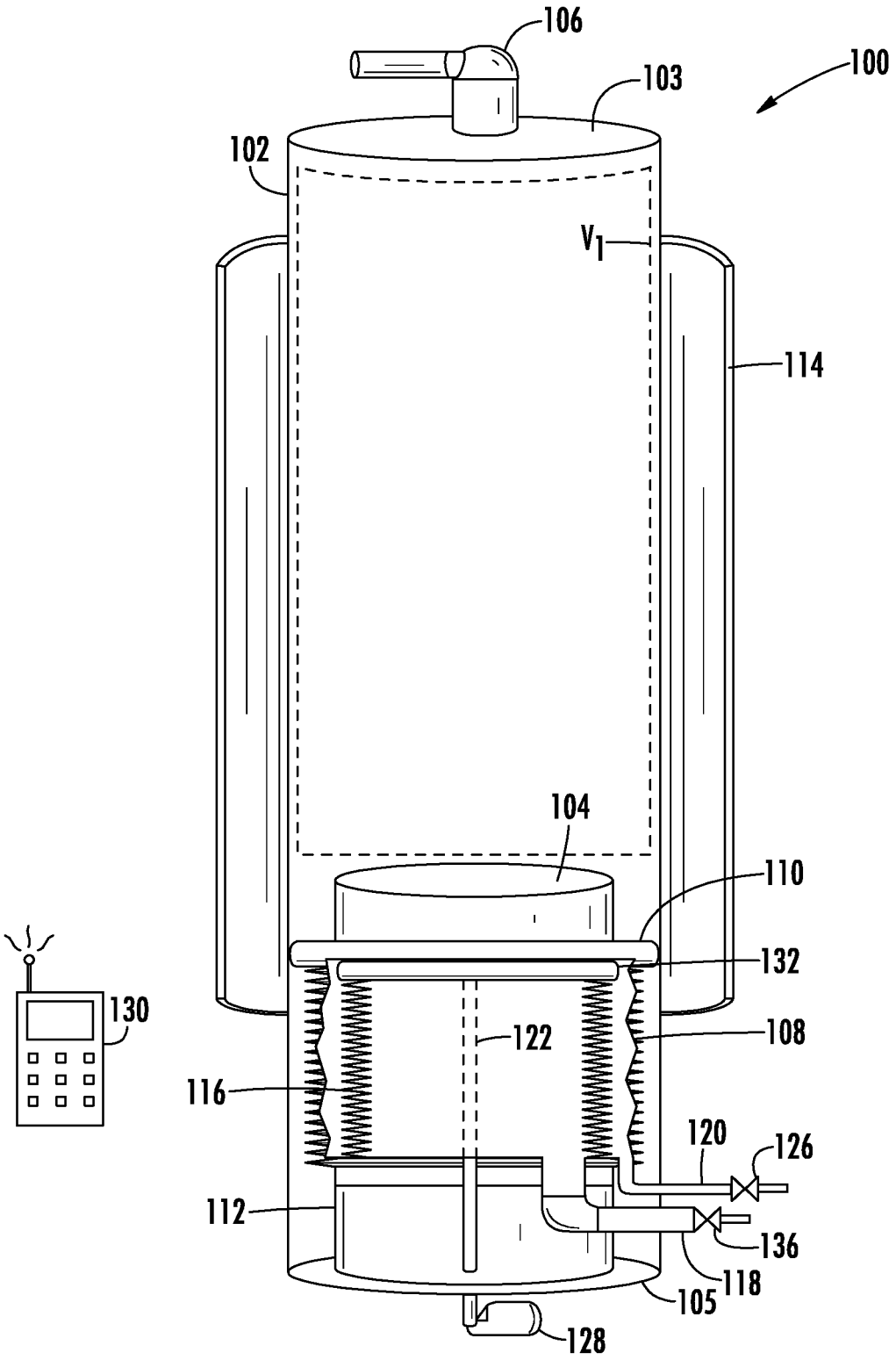
FIG. 4 is a partial cut away view of the apparatus as shown in FIG. 1.
Figure 5:
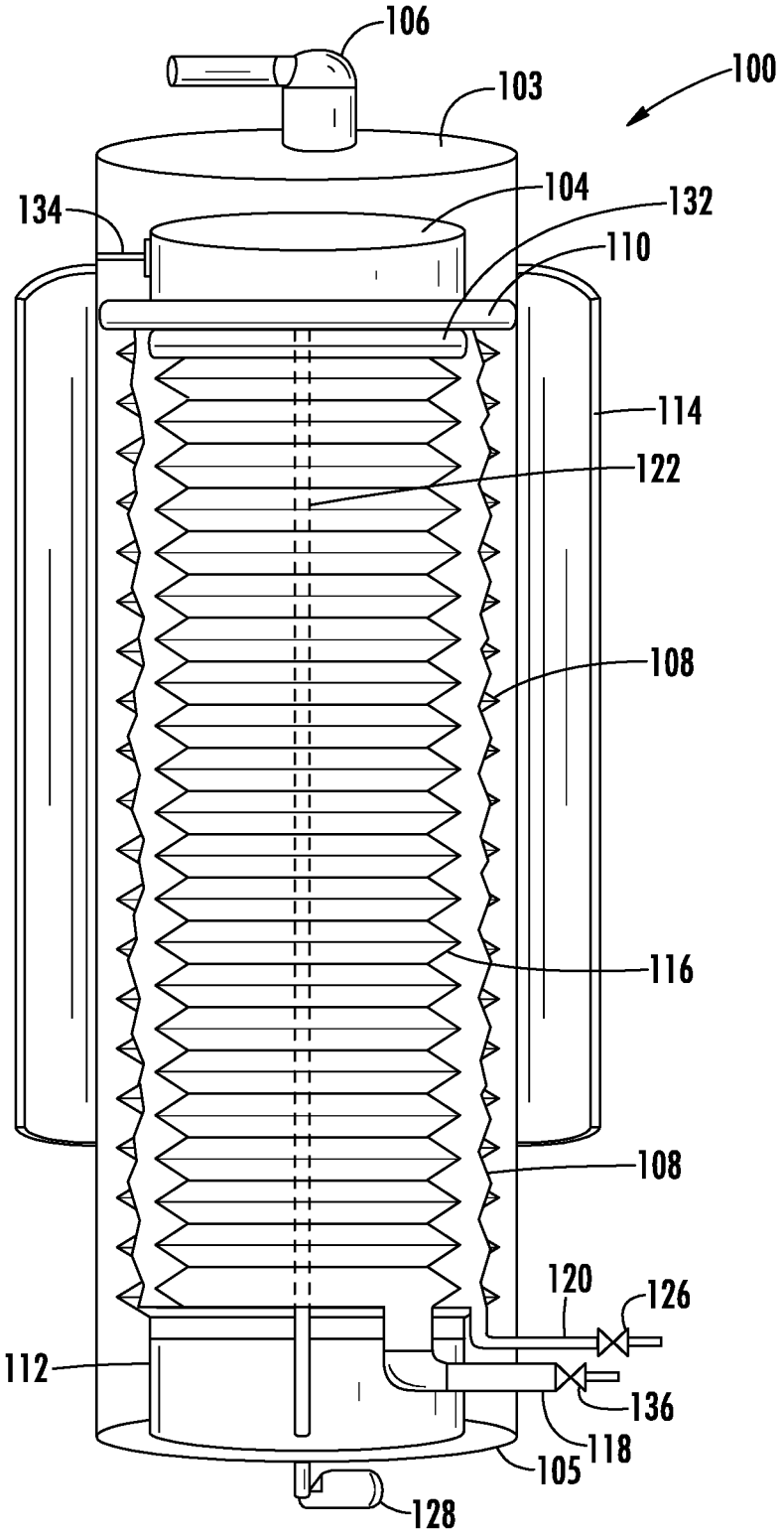
FIG. 5 is another partial cut away view of the apparatus as shown in FIG. 2.
Figure 6:
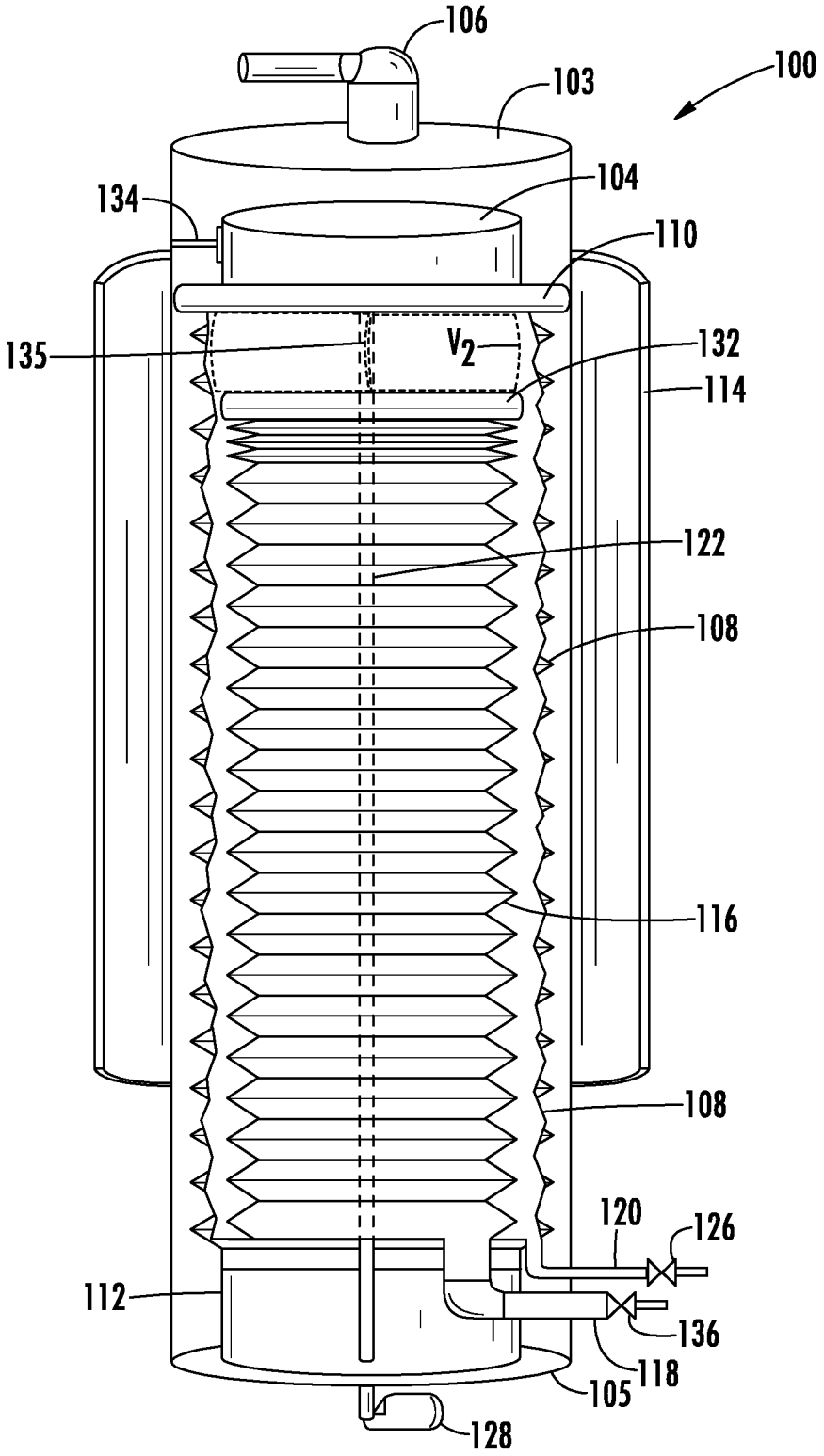
FIG. 6 is another partial cut-away view of the apparatus as shown in FIG. 2.

A linkage 122 (e.g., rod or cord) passes through the interior of the first expandable hose 116 and is coupled to a first cap 132 of the first expandable hose 116 as shown in FIGS. 4-6. The first cap 132 is rough on the outside so that it does not sit flush with the bottom of the second cap 110 (which could also be roughened). The linkage 122 is configured to pull the first cap 132 and the first expandable hose 116 towards the bottom end of the tube 102. A winch 128 may be used to pay out and retract the linkage 122 as needed during the operation of the apparatus 100.

Continuing to refer to FIGS. 4-6, the first cap 132 is secured to a top end of the first expandable hose 116 and has a first polarity. The second cap 110 is secured to the top end of the second expandable hose 108 and over the first cap 132 and has a second polarity magnetically attracted to the first cap 132. The first and second caps 110, 132 may be connected and disconnected using magnets or other suitable means. Alternately, no positive connection via magnets or mechanical means is made between the caps 110, 132.

As explained above, the sliding cylindrical body 104 is coupled to and above the second cap 110 (this could include, in some aspects, the body simply resting thereon or being incorporated into/utilizing the mass of the cap, itself). The first expandable hose 116 and second expandable hose 108 may be accordion shaped. The apparatus 100 also includes the linkage 122 that is coupled to the first cap 132 and configured to pull the first cap 132 and the first expandable hose 116 towards the bottom end of the tube 102.

The apparatus 100 may also include a controller 130 (wired and/or wirelessly) coupled to the linkage 122, the first valve 126, and the second valve 136 (if employed) and be configured to sequentially open and close the first and second valves 126, 136 and to pull the linkage 122 towards the bottom end of the tube 102 in order to break the magnetic attraction (if employed) holding the first and second caps 110, 132 together. A brake device 134 may be secured proximate to the top end 103 of the tube 102 and be configured to hold the sliding cylindrical body 104 stationary when the linkage 122 is being pulled down to break the magnetic attraction holding the first and second caps 110, 132 together. The sliding cylindrical body 104 is a magnet in a particular aspect.

In a preferred embodiment, the tube 102 has a vacuum pressure between the tube 102 and the second hose 108 indicated by a dashed box $V_1$. The pump 106 may be coupled to the top portion of the tube 102 and be configured to generate and hold a pre-determined vacuum pressure within this first sealed volume.

The sizes of the elements of the apparatus 100 described will vary depending on the amount of mass to be moved and the distance it must be moved. The operation of the apparatus 100 is described below. It assumes that the tube 102 is vertical with the two expandable hoses 108, and the sliding cylindrical body 104 sitting on top of the second expandable hose 108.

The first hole 118 at the bottom of the first expandable hose 116 is always open. At the start of an initial operation, the second valve 126 coupled to the second hole 120 will open as shown in FIG. 4. In a particular aspect, magnetic forces are holding the first and second caps 110, 132 together. As noted previously, the magnets could be omitted altogether. The amount of mass of the sliding cylindrical body 104 to be raised must be less than the force on the inside of the second cap 110 of the second expandable hose 108.

Air pressure on the bottom of the second cap 110 of the second expandable hose 108 raises the sliding cylindrical body 104 to the top of the tube 102. Once the sliding cylindrical body 104 is at the top of the tube 102, the controller 130 closes the second valve 126 for the second hole 120.

As one example of the operation of the apparatus 100, assume the following values:

R=1" radius of the second expandable hose 108
r=0.9" radius of the first expandable hose 116
W=35 lb mass of cylindrical body 104
H=50" distance sliding cylindrical body 104 will rise
Hg=27 inches of mercury vacuum in tube 102
then,
P=14.7 effective atmospheric pressure inside hoses
F=43.00 force upward on second cap 110.

Once the sliding cylindrical body 104 is at the top of the tube 102 as shown in FIG. 5, it can be held there by the brake 134 (although the brake is not required, as with sufficient vacuum drawn on the tube 102, the differential pressure is sufficient to retain the body 104 at the upper height of the hose 108. Then the linkage 122 is used to pull down the first cap 132 of the first expandable hose 116 in order to break the bond between the two expandable hoses 108, 116 being temporarily held together by magnetic forces (if magnets are employed). The linkage 122 continues to pull the first expandable hose 116 downward as shown in FIG. 6. This increases the magnitude of the second sealed volume between the hoses 108, 116. As this volume is sealed, per the operation of Boyle's Law, the pressure drops in inverse proportion with the volume increase. This reduces the air pressure on the bottom of the second cap 110 to 11.67 psi which is an effective force upwards of 35.0 lbs.

Accordingly, pulling the linkage 122 beyond 2.68 inches results in the mass of the sliding cylindrical body 104 pushing both the first and second expandable hoses 108, 116 downwards. A deployable strut 135 could be used to maintain the second sealed volume large enough to ensure continued descent without further force on the linkage. Near the bottom, the first and second expandable hoses 108, 116 are resting in an equilibrium state with a gap therebetween.

To start the cycle over, the linkage is released (if used, the strut 135 is collapsed). The rising hose 108 will reduce the magnitude of the second sealed volume between the hoses 108, 116, increases the air pressure on the bottom of the second cap 110 and resulting in the hoses 108, 116 both returning to their upper heights. The second valve 126 could also be opened to expedite their return, although this is not necessary.

Different designs may arise dependent on the particular requirements. The mass of the sliding cylindrical body 104 may be ounces or thousands of pounds. The distance the sliding cylindrical body 104 travels may be a few inches or hundreds of feet. The first and second expandable hoses 108, 116 may also be tubes moving up and down within the tube 102 and sealed with airtight seals instead of using expandable hoses.

Figure 7:
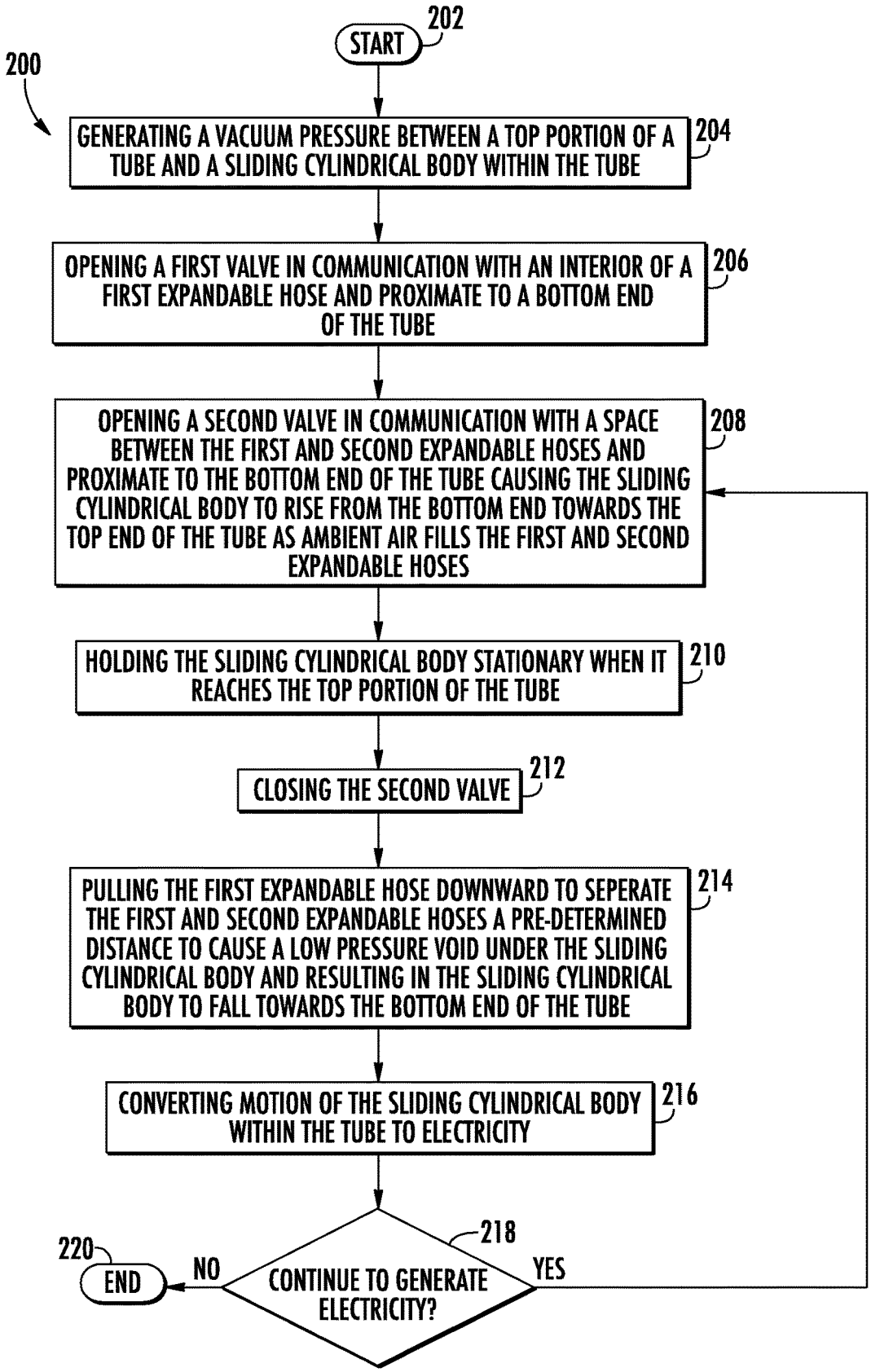
FIG. 7 is a general flowchart illustrating a method for operating the apparatus illustrated in FIGS. 1-6.

Referring now to the flowchart 200 in FIG. 7, and generally speaking, a method to generate electricity using a vacuum cylinder as illustrated in FIGS. 1-6 will be discussed. In particular, the vacuum cylinder includes a tube, a first expandable hose having a first diameter and positioned within the tube, and a second expandable hose having a second diameter larger than the first diameter and concentrically positioned around the first expandable hose within the tube, and a sliding cylindrical body coupled to and above the second cap within the tube.

From the start, at 202, the method includes generating a vacuum pressure between a top portion of the tube and the sliding cylindrical body, at 204. The method also includes, at 206, opening a first valve in communication with an interior of the first expandable hose and proximate to a bottom end of the tube, and opening a second valve, at 208, in communication with a space between the first and second expandable hoses and proximate to the bottom end of the tube causing the sliding cylindrical body to rise from the bottom end towards the top end of the tube as ambient air fills the first and second expandable hoses. Moving to 210, the method includes holding the sliding cylindrical body stationary when it reaches the top portion of the tube, closing the second valve, at 212, and pulling the first expandable hose downward to separate the first and second expandable hoses a pre-determined distance to cause a low pressure void under the sliding cylindrical body and resulting in the sliding cylindrical body to fall towards the bottom end of the tube, at 214. The method includes, at 216, converting motion of the sliding cylindrical body within the tube to electricity.

The first tube may have a first cap secured to a top end of the first expandable hose and having a first polarity, and the second tube may have a second cap secured to a top end of the second expandable hose and over the first cap and having a second polarity magnetically attracted to the first cap. The first cap may have a linkage configured to pull the first cap and the first expandable hose (and indirectly, via the manipulation of the pressure volume relationships, the second expandable hose) towards the bottom end of the tube.

As described above with respect to the operation of the apparatus 100, the method may also include using a controller coupled to the linkage, the first valve, and the second valve, and where the controller is programmed for opening and closing the first and second valves and pulling the linkage towards the bottom end of the tube in order to break a magnetic attraction holding the first and second caps together. In addition, the method may include using a pump for generating the vacuum pressure between the top portion of the tube and the sliding cylindrical body, and providing a brake device secured proximate to the top end of the tube in order to hold the sliding cylindrical body when the linkage is being pulled to break the magnetic attraction holding the first and second caps together (if magnets are used).

The method includes, at 218, repeating opening the second valve beginning at 208 in order to continue to generate electricity, and the method ends, at 220, when no more electricity is to be generated.

As explained above, the apparatus and method described herein are directed to a tube having a vacuum pressure and two hoses or tubes, one within the other, which can expand and contract, increasing the volume between them and hence decreasing the air pressure on the mass which would raise it and then using gravity to pull the mass downwards. There are other ways to increase the volume inside the tube so that the pressure upwards would be decreased, thereby allowing the weight to overcome the upward force. It is left up to the implementer to choose the most effective method for the application.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A fluid cylinder assembly comprising:

an outer cylinder extending between outer cylinder top and bottom ends, the outer cylinder top end being sealed;

an intermediate cylinder arranged within the outer cylinder extending between intermediate cylinder top and bottom ends, the intermediate cylinder top end being sealed, the intermediate cylinder bottom end being sealed to the outer cylinder bottom end such that a first sealed volume is defined between the outer cylinder and the intermediate cylinder, and the intermediate cylinder top end being collapsible towards the intermediate cylinder bottom end such that an intermediate cylinder height is variable, with the first sealed volume varying in inverse proportion to the intermediate cylinder height;

an inner cylinder arranged within the intermediate cylinder extending between inner cylinder top and bottom ends, the inner cylinder top end being sealed and the inner cylinder bottom end being sealed to the outer cylinder bottom end such that a second sealed volume is defined between the intermediate cylinder and the inner cylinder and a third volume is defined within the inner cylinder, the inner cylinder top end being collapsible towards the inner cylinder bottom end such that an inner cylinder height is variable, with the second sealed volume varying in direct proportion to a difference between the intermediate and inner cylinder heights; and a linkage connected to the inner cylinder and extending below the outer cylinder bottom end such that downward force on the linkage reduces the inner cylinder height;

wherein, in a resting condition of the fluid cylinder assembly, a first sealed volume pressure is lower than a second sealed volume pressure by a pressure differential sufficient to hold the intermediate cylinder upper end at an upper intermediate cylinder height and the second sealed volume pressure is approximately equal to a third volume pressure such that a second pressure difference is approximately zero and the inner cylinder upper end is held at an upper inner cylinder height; and wherein reducing the inner cylinder height from the upper inner cylinder height by exerting a downward force on the linkage reduces the pressure differential until the intermediate cylinder upper end falls from the upper intermediate cylinder height and releasing the downward force on the linkage results in the intermediate and inner upper cylinder ends automatically returning to the intermediate and inner upper cylinder upper heights, respectively.

2. The fluid cylinder assembly of claim 1, wherein the third volume is at atmospheric pressure.

3. The fluid cylinder assembly of claim 1, wherein the intermediate and inner cylinders are both expandable hoses.

4. The fluid cylinder assembly of claim 3, wherein the intermediate and inner cylinders both have a folded structure.

5. The fluid cylinder assembly of claim 1, wherein intermediate and inner caps seal the intermediate and inner cylinder top ends, respectively.

6. The fluid cylinder assembly of claim 5, wherein a load body is carried by the intermediate cap.

7. The fluid cylinder assembly of claim 5, wherein the intermediate cap and the inner cap have respective surfaces which face one another and at least one of the respective surfaces of the intermediate and inner caps is roughened.

8. The fluid cylinder assembly of claim 5, wherein the linkage is connected to the inner cap.

9. The fluid cylinder assembly of claim 1, further comprising a vacuum pump connected to the outer cylinder and operable to draw a vacuum on the first sealed volume.

10. The fluid cylinder assembly of claim 1, further comprising an intermediate valve communicating with the second sealed volume and operable to supply or vent fluid therefrom.

11. An apparatus to generate electricity using a fluid cylinder assembly, the apparatus comprising:

a tube having a top end and a bottom end;

a first expandable hose having a first diameter and positioned within the tube;

a second expandable hose having a second diameter larger than the first diameter and concentrically positioned around the first expandable hose within the tube;

a sliding cylindrical body arranged above the second expandable hose and having an airtight seal against the tube, the tube having a vacuum pressure between the top end of the tube and the sliding cylindrical body;

and a generator responsive to the sliding cylindrical body within the tube and configured to convert motion of the sliding cylindrical body to electricity.

12. The apparatus of claim 11, further comprising:

a first valve in communication with an interior of the first expandable hose and proximate to the bottom end of the tube; and a second valve in communication with a space between the first and second expandable hoses and proximate to the bottom end of the tube.

13. The apparatus of claim 12, further comprising:

a first cap secured to a top end of the first expandable hose and having a first polarity; and a second cap secured to a top end of the second expandable hose and over the first cap and having a second polarity magnetically attracted to the first cap.

14. A method to generate electricity using a fluid cylinder assembly comprising a tube, a first expandable hose having a first diameter and positioned within the tube, and a second expandable hose having a second diameter larger than the first diameter and concentrically positioned around the first expandable hose within the tube, and a sliding cylindrical body coupled to and above the second expandable hose within the tube, the method comprising:

generating a vacuum pressure between a top portion of the tube and the sliding cylindrical body;

opening a first valve in communication with an interior of the first expandable hose and proximate to a bottom end of the tube;

opening a second valve in communication with a space between the first and second expandable hoses and proximate to the bottom end of the tube causing the sliding cylindrical body to rise from the bottom end towards the top end of the tube as ambient air fills the first and second expandable hoses;

holding the sliding cylindrical body stationary when it reaches the top portion of the tube;

closing the second valve;

pulling the first expandable hose downward to separate the first and second expandable hoses a pre-determined distance to cause a low pressure void under the sliding cylindrical body and resulting in the sliding cylindrical body to fall towards the bottom end of the tube;

releasing the first expandable hose, resulting in the sliding cylindrical body raises towards the top end of the tube; and converting reciprocal motion of the sliding cylindrical body within the tube to electricity.

15. The method of claim 14, wherein the first and second expandable hoses have a folded structure.

16. The method of claim 14, wherein the first tube has a first cap secured to a top end of the first expandable hose and having a first polarity, and the second tube has a second cap secured to a top end of the second expandable hose and over the first cap and having a second polarity magnetically attracted to the first cap.

17. The method of claim 16, wherein the first cap has a linkage configured to pull the first cap and the first expandable hose towards the bottom end of the tube.

18. The method of claim 14, further comprising using a controller coupled to the linkage, the first valve, and the second valve, and the controller programmed for opening and closing the first and second valves and pulling the linkage towards the bottom end of the tube in order to break a magnetic attraction holding the first and second caps together.

19. The method of claim 18, wherein the sliding cylindrical body comprises a magnet.

20. The method of claim 19, further comprising:

using a pump for generating the vacuum pressure between the top portion of the tube and the sliding cylindrical body.

* * * * *